US005228774A

United States Patent [19]

Liao

[11] Patent Number: 5,228,774

[45] Date of Patent: Jul. 20, 1993

[54] SAFE LIGHT SET

[76] Inventor: Nan W. Liao, No. 18, Tzu Yu Road, Hsinchu, Taiwan

[21] Appl. No.: 789,600

[22] Filed: Nov. 8, 1991

[51] Int. Cl.[5] ..... F21V 21/08; F21V 21/34

[52] U.S. Cl. ..... 362/391; 362/396

[58] Field of Search ..... 362/226, 249, 250, 252, 362/391, 806, 396; 439/182, 186

[56] References Cited

U.S. PATENT DOCUMENTS

| | | | |
|---|---|---|---|
| 2,018,836 | 10/1935 | Clemence | 362/391 |
| 2,253,164 | 8/1941 | Benander | 362/391 |
| 2,559,706 | 7/1951 | Brooks | 362/391 |
| 4,777,573 | 10/1988 | Liao | 362/249 |
| 5,051,877 | 9/1991 | Liao | 362/806 |
| 5,109,324 | 4/1992 | Ahroni | 362/391 |

FOREIGN PATENT DOCUMENTS

| | | | |
|---|---|---|---|
| 986606 | 3/1965 | United Kingdom | 362/391 |

*Primary Examiner*—Richard R. Cole

*Attorney, Agent, or Firm*—Morton J. Rosenberg; David I. Klein

[57] ABSTRACT

A safe light set of the type used for decorative light strings is provided. Each light socket of the set includes a parallel hook having an inner surface with a gripping surface contour formed therein. The hook is formed on the cap of the light socket for engagement with support from which it is hung. The socket includes a short vertical conductor dimensioned to just contact with the threaded metal portion of the bulb when fully engaged within the socket, and to be electrically separated from the metal portion of the bulb when loosening the bulb, at the point at which the metal portion emerges from the socket.

4 Claims, 9 Drawing Sheets

SAFE LIGHT SET

BACKGROUND OF THE INVENTION

In prior art systems, a light set includes a light socket and a light bulb. A hook is then provided on a side of the light socket, as in U.S. Pat. No. 5,051,877, FIG. 9. Every light set is hung on the electric wires by the hook of each light socket. In use, it can be found that each light set is inclined and the light set string looks bad. When a light bulb is broken, it is typically replaced without turning off the electric source. During rotation of the bulb, one may touch metal parts of the bulb and get an electric shock.

SUMMARY OF THE INVENTION

It is the purpose of this invention to mitigate and/or obviate the above-mentioned drawbacks in the manner set forth in the detailed description of the preferred embodiment.

A primary objective of the present invention is to provide a safe light set which has a parallel hook for hanging the light set perpendicular to the electric wires.

Another objective of the present invention is to provide a safe light set where a broken light bulb can be replaced safely.

Further objectives and advantages of the present invention will become apparent from the following detailed description when considered in connection with the accompanying drawings wherein:

DETAILED DESCRIPTION OF THE PREFERRED EMBODIMENT

Figure 1:
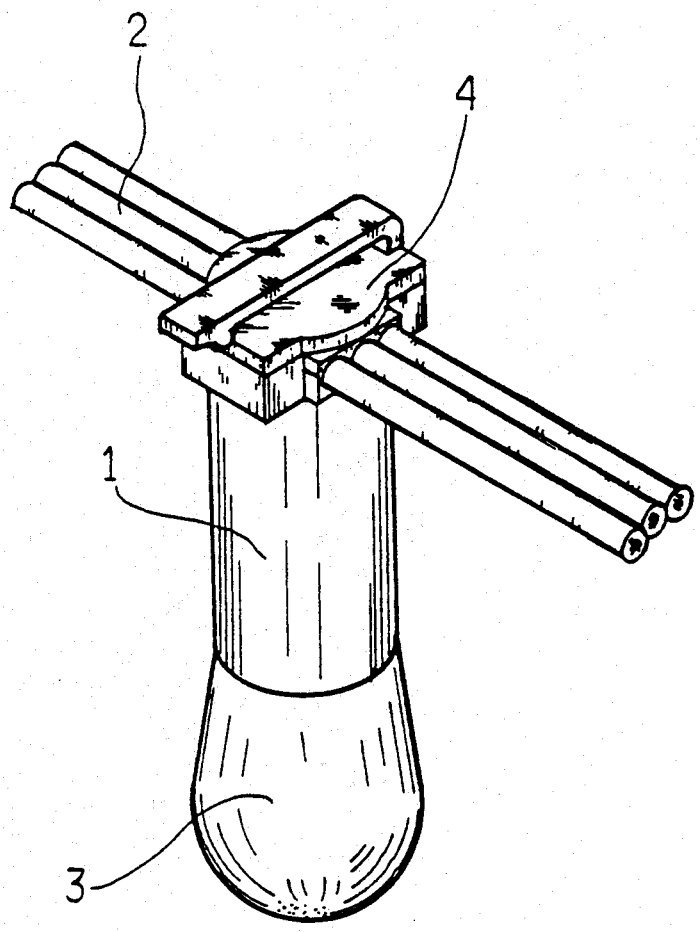
FIG. 1 is a perspective view of a preferred embodiment in accordance with the present invention.
Figure 2:
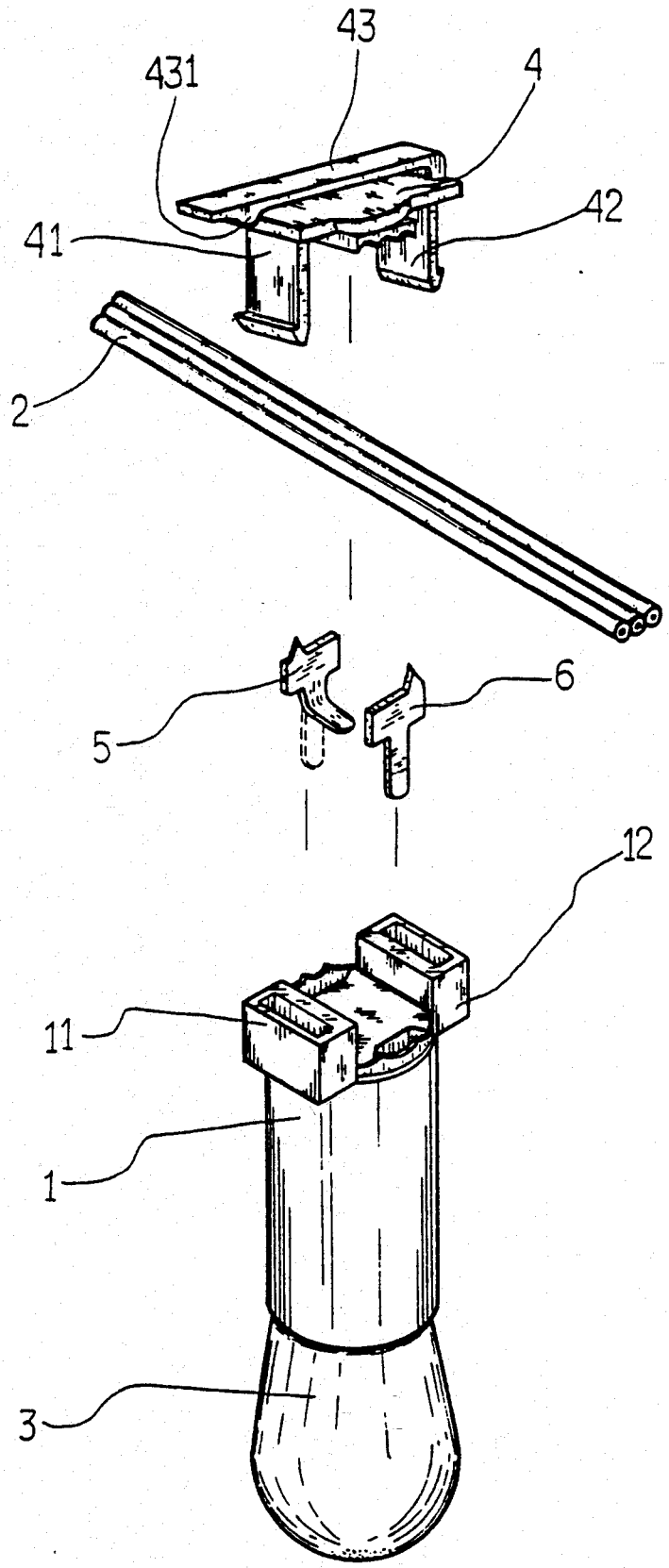
FIG. 2 is an exploded perspective view of the embodiment of FIG. 1 in accordance with the present invention.

Referring to FIGS. 1 and 2, the present invention includes a light bulb 3, a light socket 1 having an internal thread for receiving the light bulb, electric wires 2 and a cap 4 on one end of the light socket 1. A pair of conductors 5, 6 are provided in the light socket 1 for electrically coupling the light bulb 3 to the electric wires 2. The function of which is the same as that of prior art systems and will not be described in any further detail. The structure of the present invention includes a pair of inserts 41, 42 being formed on the bottom of the cap 4 to engage with a pair of receivers 11, 12 being formed in the socket 1. A parallel hook 43 is formed on the cap, and includes a projection 431 formed at the open end to engage a support thereby. It can be understood that the light set of the present invention is capable of being hung vertically by means of the parallel hook 43.

Figure 3:
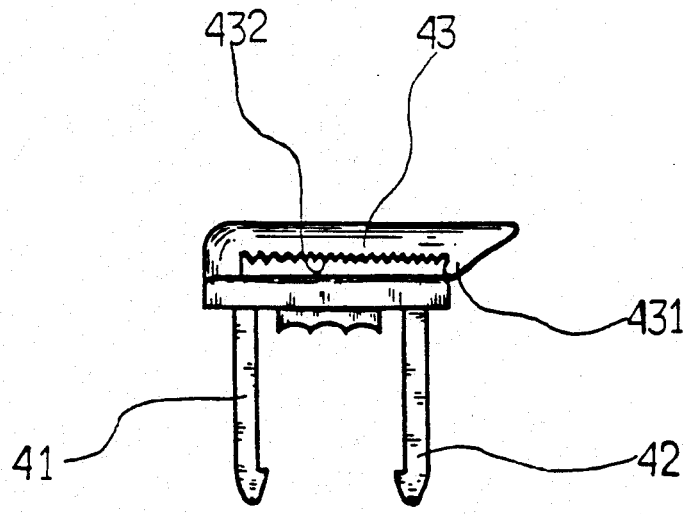
FIG. 3 is a plan view of a light socket cap with another hook type of a preferred embodiment in accordance with the present invention.
Figure 4:
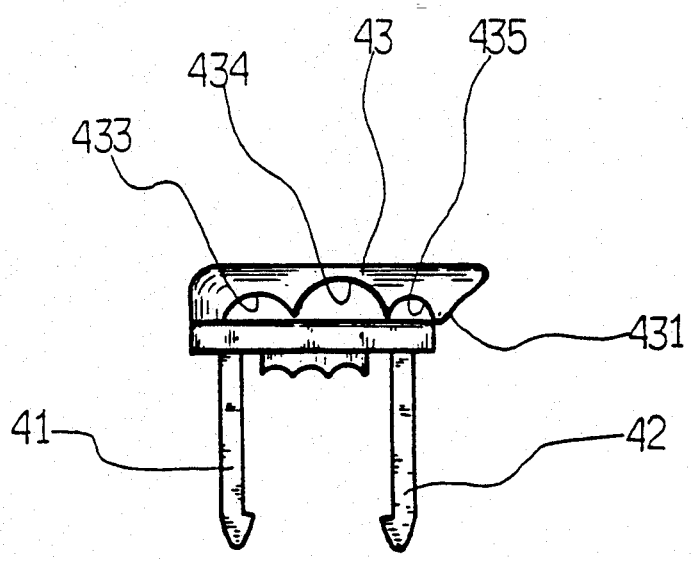
FIG. 4 is a plan view of a light socket cap with a further hook type of a preferred embodiment in accordance with the present invention.
Figure 5:
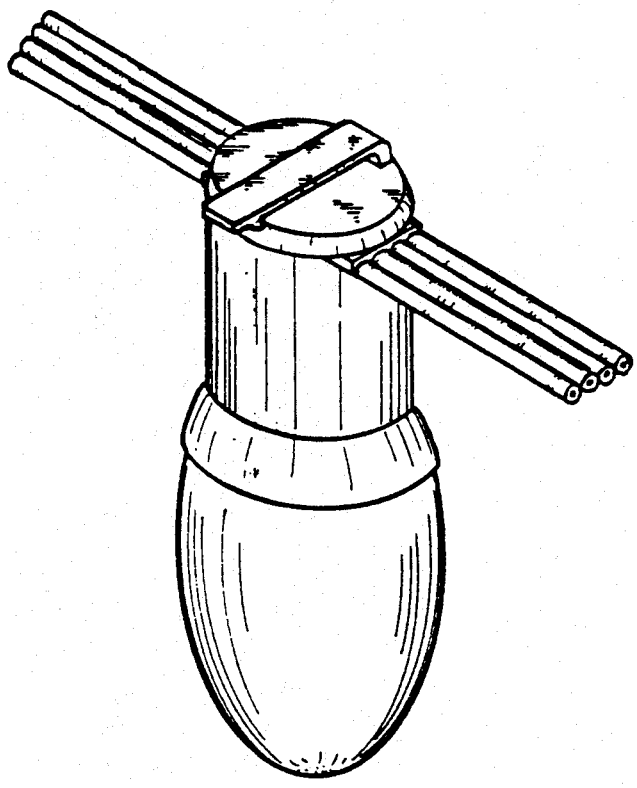
FIG. 5 is another perspective view of a preferred embodiment in accordance with the present invention.
Figure 6:
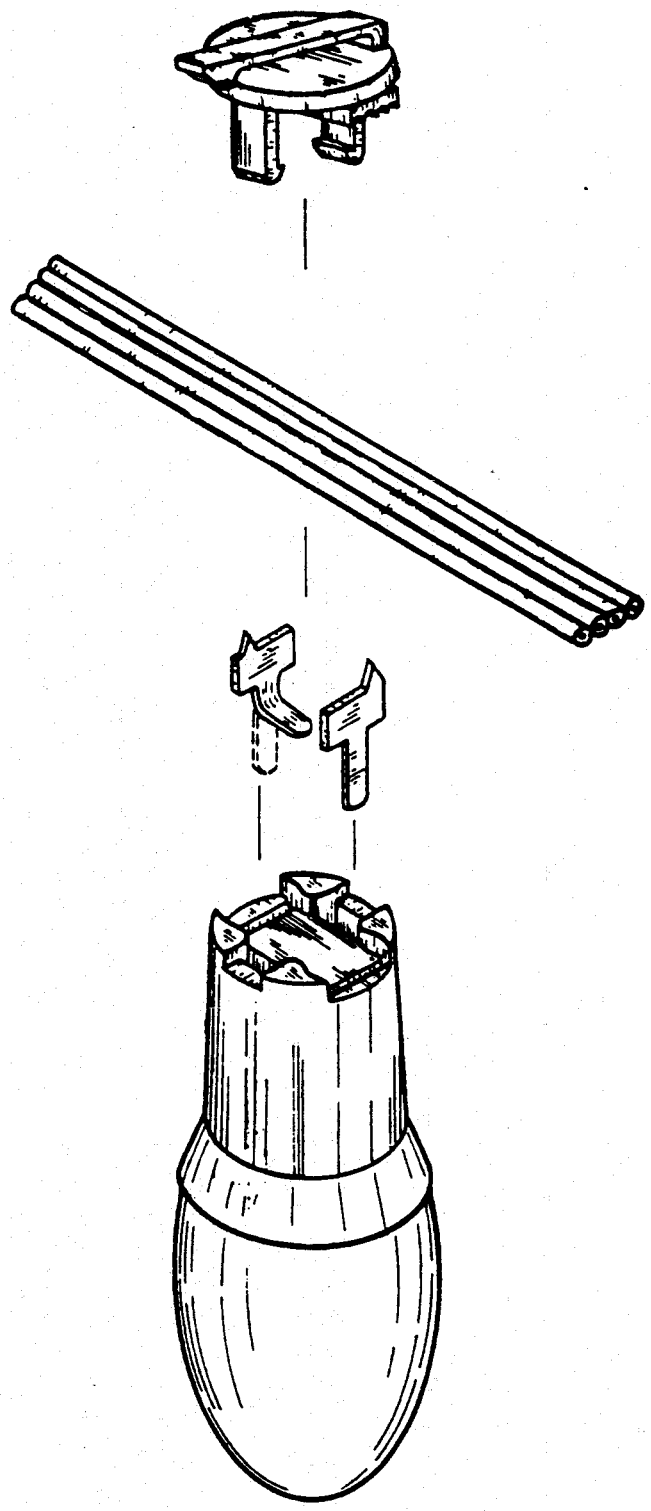
FIG. 6 is an exploded perspective view of FIG. 5 in accordance with the present invention.

Referring to FIG. 3, it can be seen that the hook 43 is formed with an inner surface 432 having a sawtoothed cross-sectional configuration for firmly engaging a support. FIG. 4 shows another inner surface including different sizes of channels 433, 434, and 435, each having a semicircular cross-sectional configuration for engaging firmly with different diameters of support members. FIGS. 5 and 6 represent another preferred embodiment of this invention.

Figure 7:
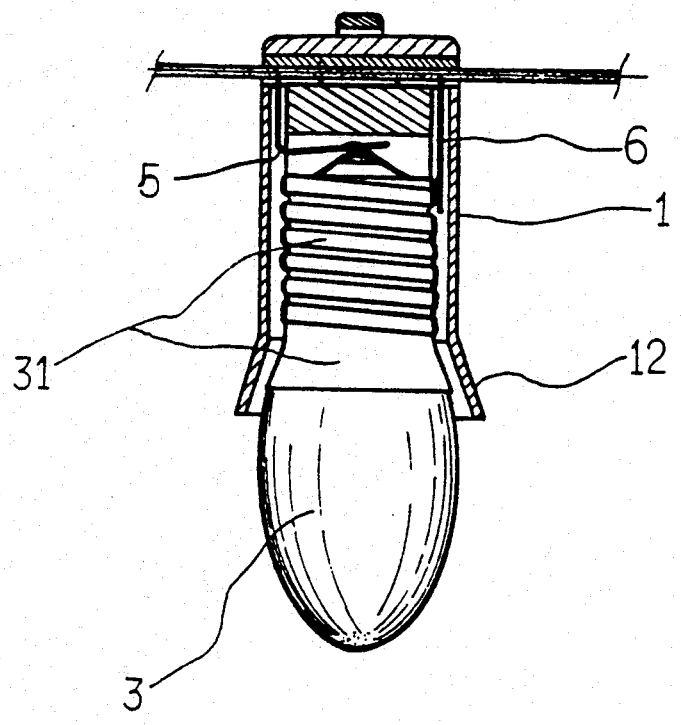
FIG. 7 is a cross-sectional view of the embodiment of FIG. 5 in accordance with the present invention.
Figure 8:
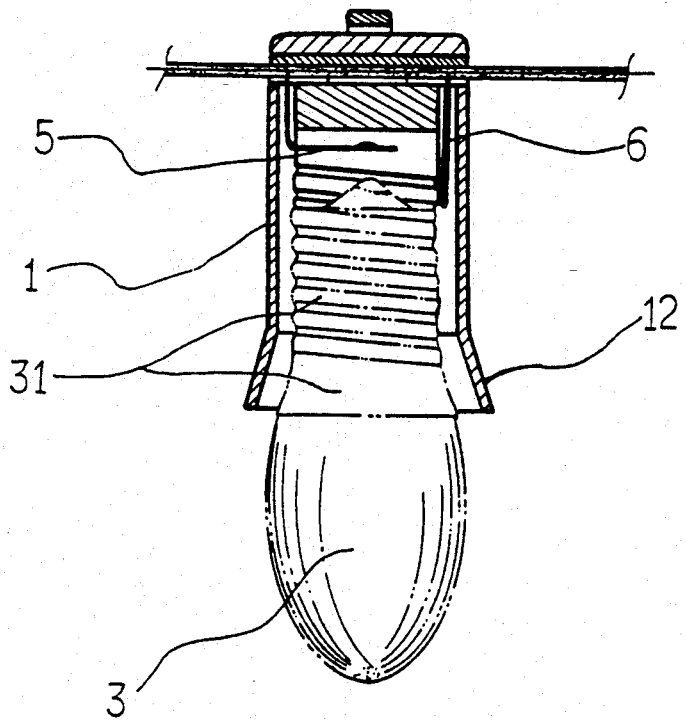
FIG. 8 is a cross-sectional view of the embodiment of FIG. 5 in loosened state in accordance with the present invention; and, FIG. 9 is a perspective view of a prior art system.
Figure 9:
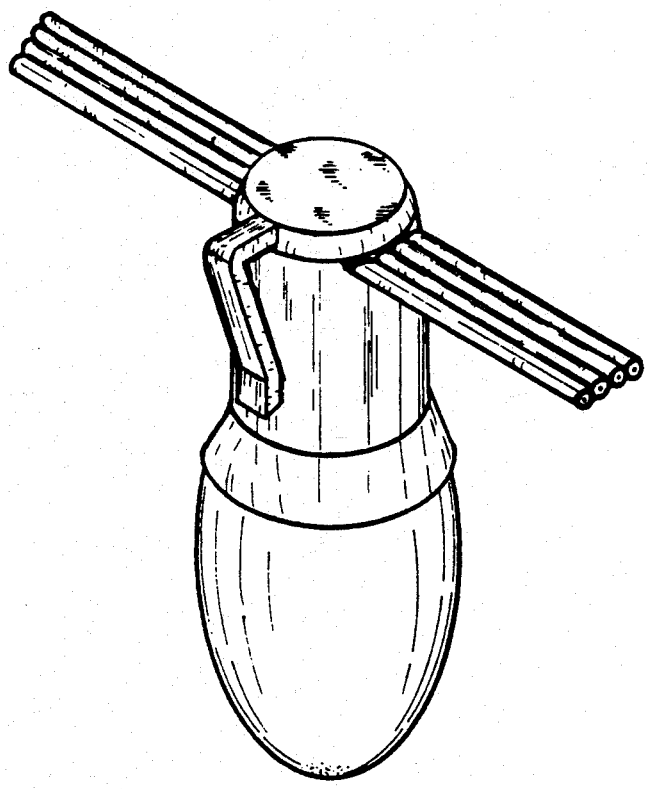

Referring to FIGS. 7 and 8, there is shown another embodiment of the present invention where the conductor 6 is formed having a predetermined length dimension, the dimension being such that conductor 6 contacts the endmost area of the metal portion 31 of the bulb 3 when the bulb is fully engaged in the socket. When this bulb 3 is broken, it can be safely removed while power is still connected to the wires. Since the metal portion 31 of the bulb 3 is covered by the socket, it can initially be rotated safely. As the metal portion 31 is revealed when the bulb is rotated, the metal portion 31 of the bulb 3 is separated from the conductor 6. Thus, it can be seen that the metal portion 31 of bulb 3 will be safe to touch, as it is electrically connected to the power source, and there is therefore no danger of an electric shock.

Although this invention has been described in connection with specific forms and embodiments thereof, it is to be understood that all matter herein described or shown in the accompanying drawings is to be interpreted as illustrative and not in a limiting sense. Thus it will be appreciated that the drawings are exemplary of a preferred embodiment of the invention. Various modifications may be made without departing from the scope of the appended claims.

I claim:

1. A safe light set having a plurality of light sockets electrically coupled to a pair of conductors for lighting a plurality of lamps respectively threadedly engaged with said light sockets, each of said lamps having a metallic threaded portion defining a base electrode, each of said light sockets comprising:

a socket member having a threaded recess formed therein for coupling with a respective one of said plurality of lamps;

a pair of contact members disposed within said socket member for electrically coupling said lamp with said pair of conductors, a first of said pair of contact members having a predetermined length dimension for contact with an endmost portion of said base electrode when said lamp is fully engaged within said socket member, a second of said pair of contact members being disposed within said socket member for contact with a centrally located electrode of said lamp, whereby electrical contact is broken between said base electrode and said first contact member prior to egress of said base electrode from within said threaded recess of said socket member as said lamp is being threadedly disengaged therefrom;

a cap member having a pair of barbed projections for locking engagement with one end of said socket member for securing said pair of conductors there-between, said cap member having a longitudinally extended hook integrally formed on an end surface thereof.

2. The safe light set as recited in claim 1 where said hook is provided with an inner surface having a plurality of recess openings formed transverse said longitudinal direction for engaging a support member therein.

3. The safe light set as recited in claim 2 where each of said plurality of recess openings has a semicircular cross-sectional contour, each of said recess openings having a diameter dimension different from any of said other recess openings.

4. The safe light set as recited in claim 2 where said plurality of recess openings define a sawtooth cross-sectional contour.

* * * * *